US005579543A

United States Patent [19]

Crawford et al.

[11] Patent Number: 5,579,543

[45] Date of Patent: Dec. 3, 1996

[54] METHOD FOR TRANSFERRING A PATIENT BETWEEN A BED AND A BATH TUB

[75] Inventors: Michael K. Crawford; Joseph M. Crawford; James R. Crawford, all of Houston, Tex.

[73] Assignee: Easy Lift Products, Inc., Houston, Tex.

[21] Appl. No.: 429,071

[22] Filed: Apr. 26, 1995

Related U.S. Application Data

[63] Continuation-in-part of Ser. No. 241,723, May 12, 1994, which is a continuation-in-part of Ser. No. 359,285, Dec. 19, 1994, abandoned, which is a division of Ser. No. 241,619, May 12, 1994, abandoned.

[51] Int. Cl.[6] ..... A47K 3/162

[52] U.S. Cl. ..... 4/540; 4/560.1; 4/592; 5/900; 5/928

[58] Field of Search ..... 4/576, 540, 546–550, 4/555, 560.1, 561.1, 584, 592, 593, 594, 480; 5/600, 606, 611, 900, 928

[56] References Cited

U.S. PATENT DOCUMENTS

| | | | |
|---|---|---|---|
| 2,576,623 | 11/1951 | McLaughlin | 4/555 |
| 3,300,790 | 1/1967 | Foote | 4/580 |
| 3,436,769 | 4/1969 | Burst | 5/616 |
| 3,534,748 | 10/1970 | Ekman | 4/540 X |
| 3,559,216 | 2/1971 | Kyte | 4/540 |
| 3,559,634 | 2/1971 | Lillywhite | 4/584 X |
| 3,755,830 | 9/1973 | Johns | 4/585 |
| 4,009,273 | 7/1978 | Colby | 4/540 |
| 4,170,045 | 10/1979 | Estes | 4/592 X |
| 4,207,629 | 6/1980 | Kawaga | 4/540 |
| 4,305,165 | 12/1981 | Wall, Jr. | 4/549 |
| 4,334,330 | 6/1982 | Marshall | 4/480 |
| 4,435,861 | 3/1984 | Lindley | 5/618 |
| 4,713,850 | 12/1987 | Flaherty et al. | 4/585 |
| 4,998,302 | 3/1991 | Silva | 4/516 |
| 5,054,136 | 10/1991 | Inagaki | 4/546 |

FOREIGN PATENT DOCUMENTS

| | | | |
|---|---|---|---|
| 4114011 | 11/1992 | Germany . | |
| 0163659 | 8/1985 | Japan | 4/540 |
| 1389522 | 4/1975 | United Kingdom . | |

OTHER PUBLICATIONS

ARJO–CENTURY INC: World Class Hygiene and Therapy, Apr. 1993, 2 pages.

Smith & Davis, High Tech Comes To Homecare Beds, P/N 02001876, No date, 6 pages.

Excerpt from GB 1,229,165, Aug. 1970, 2 pages.

Abstract of EP 330,636, Aug. 1989, 1 page.

Abstract of WO 9,418,930, Sep. 1994, 7 pages.

*Primary Examiner*—Robert M. Fetsuga

*Attorney, Agent, or Firm*—Moseley; Riddle & Jackson, L.L.P. Bush

[57] ABSTRACT

A method is disclosed for transferring a patient in a prostrate position sidewise between a bath tub (20, 20A, 20C) and bed (10, 10A, 10C) without lifting of patient (P). The method includes the steps of sliding a patient P over a front side (76) into the bottom (70) of the tub for bathing the patient, and returning the patient after bathing over the front side to the bed (20). The front side (76) of the tub (20, 20A, 20C) overlaps the mattress (12, 12A, 12C) and is supported thereon. The bed frame (14, 14B) and mattress (12, 12B) are movable vertically for raising and lowering the tub (20, 20A, 20C). The patient is moved into and out of the tub (20, 20A, 20C) when the tub (20, 20A, 20C) is in a lowered position, and is bathed with the tub in the raised position.

12 Claims, 9 Drawing Sheets

FIG.10
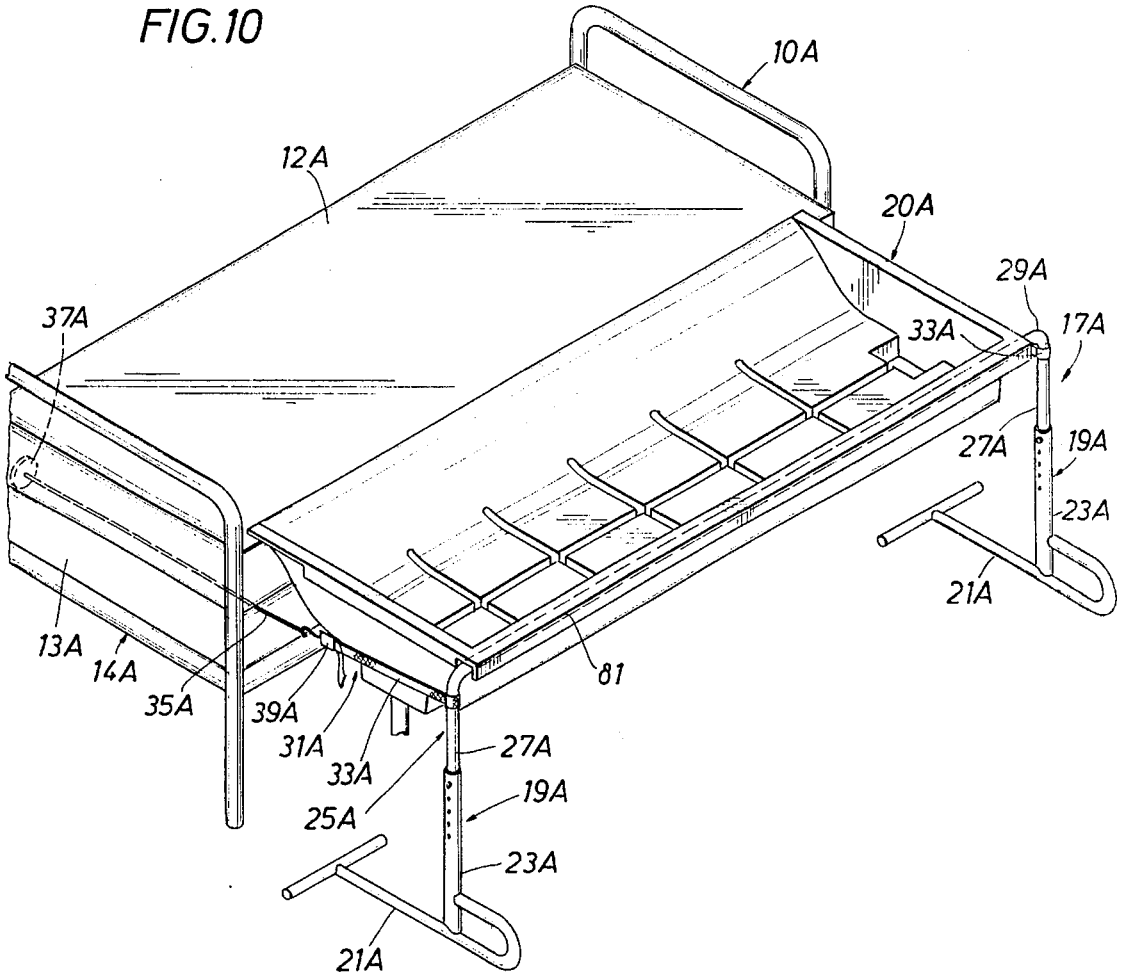
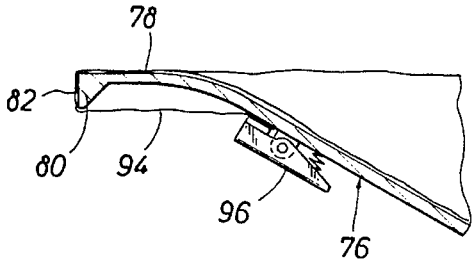
FIG.8
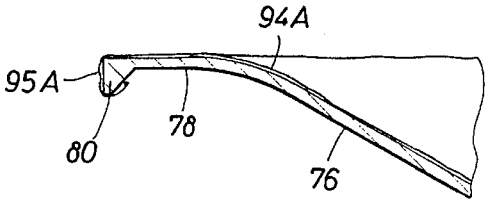
FIG.9

10C
12C
20C
227
220
200
222
218
216
14C
83
88
214
17C
218
17C
16
16
232
202
210
214
216

208
206
204
208
206
204
17C
204
17C
232
202
212
210
213
212
214
218

10
227
20c
200
220
83
222
222
88
219
218
17C
14C
17C
203
230
202
204
214
206
215
216
206
217

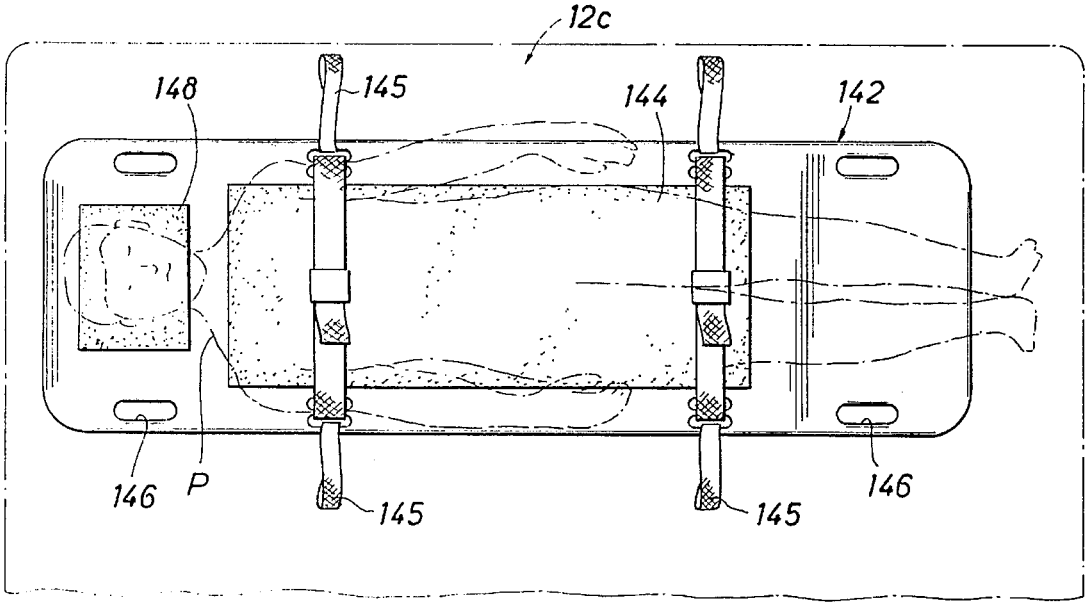
FIG. 18
FIG. 19
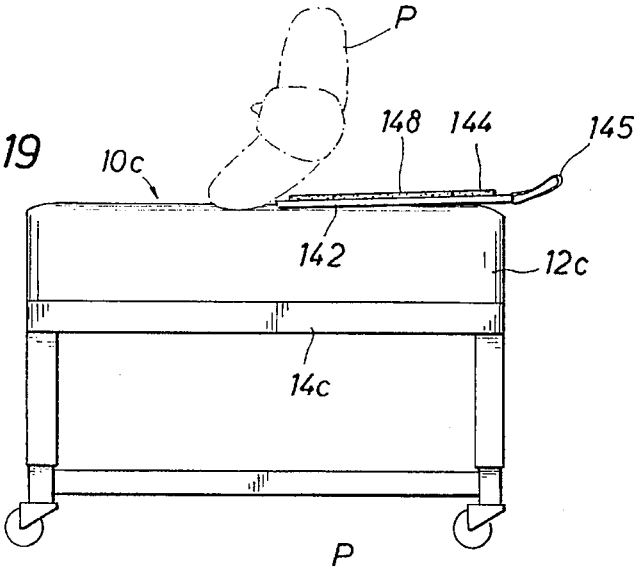
FIG. 20
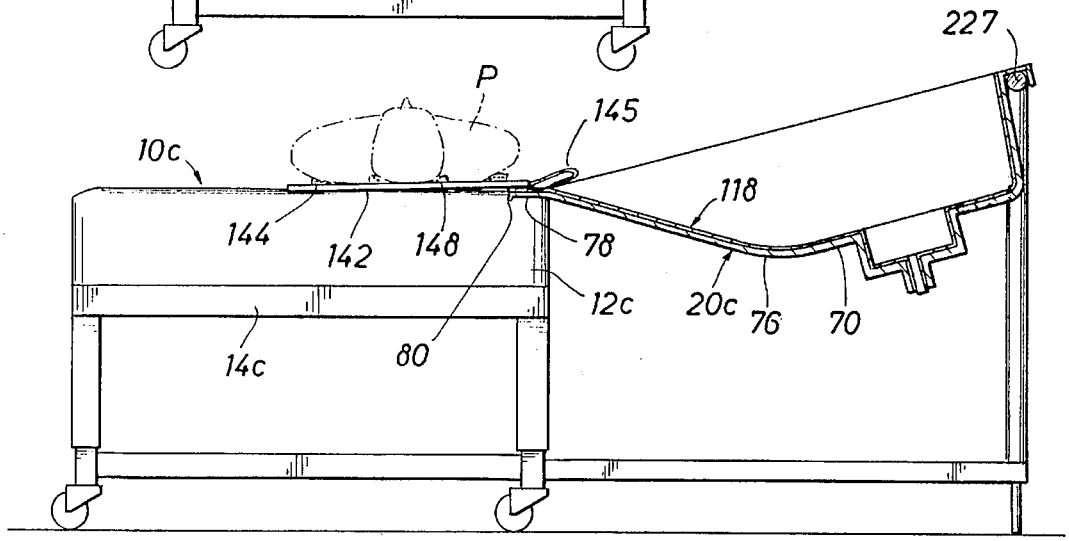

METHOD FOR TRANSFERRING A PATIENT BETWEEN A BED AND A BATH TUB

REFERENCE TO RELATED APPLICATION

This application is a continuation-in-part of application Ser. No. 08/241,723 filed May 12, 1994 and a continuation-in-part of application Ser. No. 08/359,285 filed Dec. 19, 1994, abandoned which is a division of application Ser. No. 08/241,619 filed May 12, 1994, abandoned.

FIELD OF THE INVENTION

This invention relates generally to a method for bathing a patient, and more particularly to a method for transferring a patient sidewise in a prostrate position between a bed and a bath tub for bathing a patient with no need for patient lifting.

BACKGROUND OF THE INVENTION

Patients in hospitals and nursing homes and bedridden persons in homes, are usually not able to bathe themselves, particularly without assistance. Many patients have physical disabilities which prevent them from getting out of a bed and into a bath tub without assistance from a care provider. While wiping a patient with a damp or steamed towel may be employed in lieu of a bath, a bath in a tub is preferred in order to remove filth, particularly body waste. It is desirable, however, to move a bedridden patient as little as possible for a bath because pain is often incurred by a patient during movement. It is also desirable that care providers not be required to lift a patient from a bed to a tub. Labor laws and regulations increasingly restrict employed nurses, nurses aids and the like from lifting patients so as to prevent back and muscle injuries.

Heretofore, bath tubs have been especially designed for patients in hospitals and nursing homes, or bedridden persons in homes. However, most of such prior tubs have required substantial movement of a patient in order for such patient to move from a bed into and out of tubs. For example, U.S. Pat. No. 4,207,629 dated Jun. 17, 1980 discloses tub equipment for bedridden patients where a patient is required to stand to enter via an end of a tub. After a bath, a patient must stand again to return to bed. A patient is not moved sidewise, but instead, is moved into and out of a tub from its end. Movements of a patient to a standing position increase the possibility of a patient slipping or falling when getting into a tub and when exiting a tub. Such movements may require substantial lifting efforts on the part of a care provider.

U.S. Pat. No. 5,054,136 dated Oct. 8, 1991, shows a bed having an integral bath tub slidably mounted from a bed. A vertically movable mat is provided for lowering a patient into a bath tub positioned below the bed and for raising such patient from the bath tub. The '136 tub does not overlap a bed and does not move vertically with a bed. A mat on which a patient is supported is moved by mechanical power means between tub and bed. A mechanism of the '136 patent for moving a patient between bed and bath tub is relatively complex.

U.S. Pat. No. 3,534,748 dated Oct. 20, 1970 shows one embodiment, particularly in FIG. 8, in which a bath tub is adapted to have one side extend beneath a supporting member of an adjacent carriage. A stretcher is provided on the carriage for the transfer of a patient between carriage and tub. The tub is tilted by power means on the tub structure and is not supported or tilted by the carriage. The stretcher may be lifted by the tub; the carriage may then be withdrawn. Thus, the tub is used for raising and lowering a stretcher with a patient thereon for bathing.

SUMMARY OF THE INVENTION

The method of the present invention is for transferring a bedridden patient sidewise from a patient support surface of a bed to a tub for bathing the patient. The method includes positioning a bath tub having a front side by the side of a bed and overlapping its patient support surface with a front side of the tub so that a bridge is provided between bed and bath tub for sliding a patient thereover. The bed includes a vertically movable bed frame; the front side of the bath tub is movable vertically with the bed frame and patient support surface. The method includes lowering of the bath tub and patient support surface of the bed for sidewise transfer of a patient from the bed to the tub, and then raising the bed frame and patient support surface thereon along with the bath tub to an upper position for bathing the patient. For return of a patient to the bed after bathing, the bath tub and support frame for the bed are lowered and the patient is transferred sidewise via tile front side of the tub to the bed. A rigid liner may be inserted within the bath tub prior to the bathing of the patient and then removed from the bathtub after the patient has been bathed.

The patient is preferably placed on a slide board while on tile bed. The slide board and the patient are then moved manually into the bath tub for bathing of the patient while the patient is on the slide board in a prostrate position. After bathing the patient, the patient is returned to the bed on the slide board by reversing the steps mentioned above. Advantageously, lifting of the patient is not required in order to bathe the patient and to transfer the patient between bed and bath tub.

Other features and advantages of the invention will be apparent from the following specification and drawings.

BRIEF DESCRIPTION OF THE DRAWINGS

FIG. 8 is an enlarged section of a projecting edge portion of the front side of the bath tub showing a clip for removably securing a flexible liner to the bath tub;

FIG. 9 is an enlarged section similar to FIG. 8 but shows a separate embodiment of a flexible liner in which a flexible liner is mounted over a downwardly projecting member of a sides of the bath tub, FIG. 10 is a perspective view of another separate embodiment of the bath tub assembly of this invention in which a portable support frame is mounted alongside a bed for supporting a bath tub with the support frame arranged and designed for disassembly so that it can be moved to another bed;

FIG. 18 is a top plan of a mattress on a bed showing a patient on a slide board on the mattress with the slide board arranged and designed for sliding movement of the patient from the bed along the upper surface of the bath tub to the bottom of the tub for bathing of the patient; and FIGS. 19–23 are schematic views showing a preferred sequence for transferring a patient on the slide board of FIG. 18 from a bed to the bath tub for bathing, and then returning the patient to the bed after bathing.

DESCRIPTION OF THE INVENTION

EMBODIMENT OF FIGS. 1–8

Figure 1:
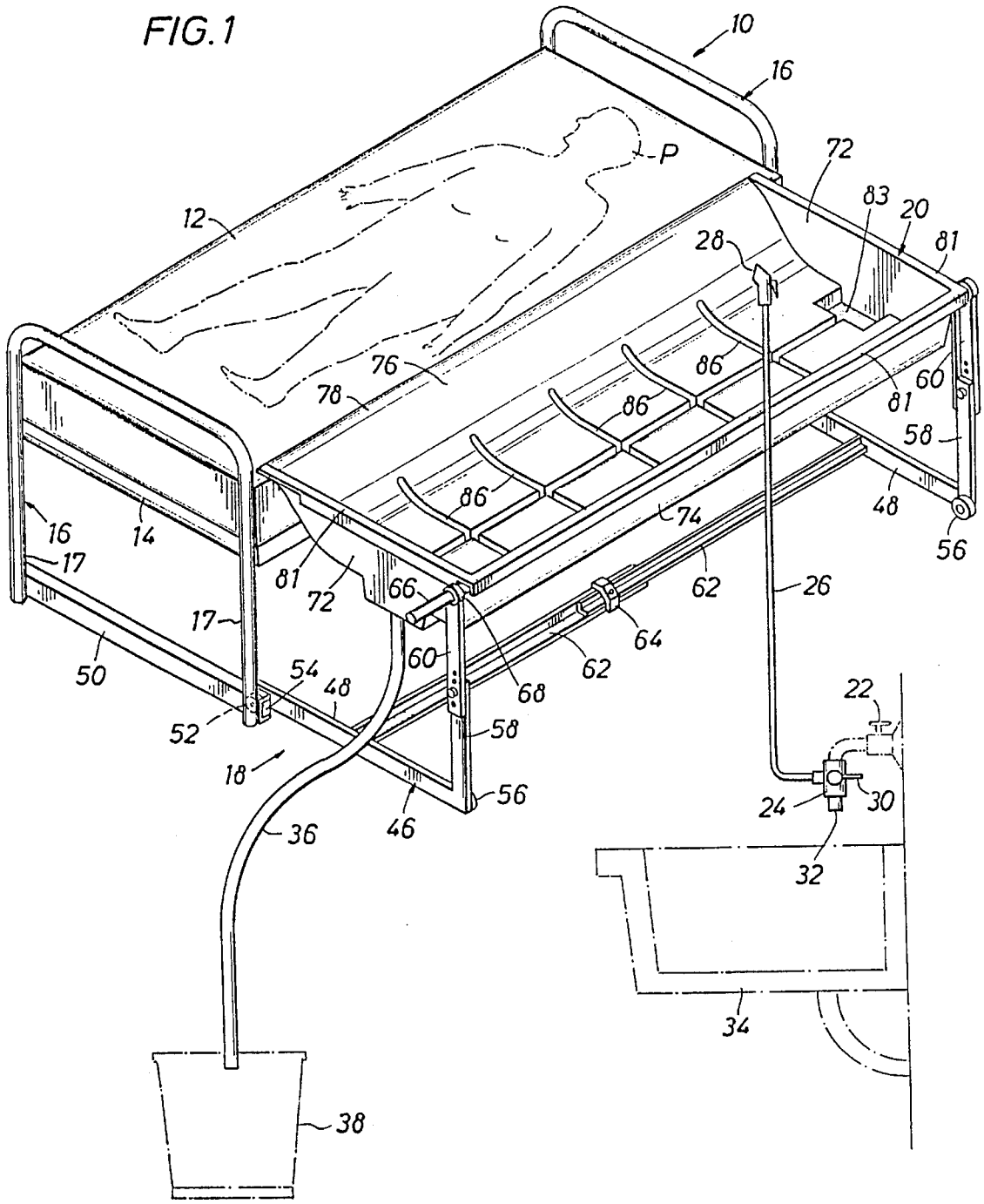
FIG. 1 is a perspective view, partly schematic, of an embodiment of the invention showing a bath tub assembly positioned alongside a bed for bathing of a patient after a sidewise transfer of the patient to the bath tub in a prostrate position.

Referring now to the drawings for a better understanding of the invention, and more particularly to the embodiment shown in FIGS. 1–8, a bed is shown generally at 10 including a patient support surface such as mattress 12 on which a bedridden patient P is supported in a prostrate position. Mattress 12 is supported on a vertically movable lower support frame 14 which may be moved vertically about ten (10) inches relative to bed end flames 16 having legs 17. Frame 14 and mattress 12 may be moved manually by a suitable hand crank (not shown) or by electrically actuated means. Suitable hospital or home care beds are available to provide vertically movable support frames for a mattress as shown hereinafter particularly in FIGS. 13 and 14.

A bath tub assembly is shown generally at 18 positioned along the side of mattress 12 and patient P for sidewise movement of patient P into a bath tub or bath tub body generally indicated at 20. Water is supplied to tub 20 from a water supply faucet 22. A valve 24 is removably connected to faucet 22. A flexible hose 26 leads from valve 24 to a manually operated spray nozzle 28. Valve 24 is manually operated by lever 30 to selectively supply water to hose 26 and nozzle 28 or to discharge water from outlet 32 into a drain basin shown generally at 34 when faucet 22 is turned on. Water may be discharged from outlet 32 until a desired temperature is obtained; then lever 30 may be actuated to direct water to hose 26 and nozzle 28 for supplying water to tub 20. Faucet 22 controls both the supply of hot and cold water to obtain the desired water temperature for bathing the patient.

To remove waste bath water from bath tub 20 during and after bathing of patient P, a flexible discharge hose 36 extends from tub 20 to a portable water collection container or bucket generally indicated at 38. Collection container 38 is portable, lightweight, and may be easily moved from one location to another location.

A retractable support frame of the embodiment of FIG. 1 generally indicated at 46 is attached to bed 10 for supporting bath tub 20. Support frame 46 has a pair of lower frame members 48 mounted for sliding movement along channel-shaped guide rails 50 secured to legs 17 and forming tracks. Frame members 48 have rollers 52 at one end mounted in the tracks formed by channel-shaped members 50 for movement. An abutment 54 closes the end of each guide rail 50 to block outward movement of support frame 46 and to position frame 46 accurately. Rollers 56 on lower frame members 48 support frame 46 on the floor for sliding movement between the retracted inoperable position shown in FIG. 2 and the extended operable position shown in FIG. 1.

Adjustable vertical frame members or posts are secured to lower frame members 48 and include lower portions 58 and upper portions 60 having aligned openings to receive pins for manually adjusting the height of the posts for accommodating the height of bed 10. To adjust the length of frame 46, lower brace members 62 extending between lower frame members 48 are adjustable by straps 64. An upper horizontal frame member 66 extends between the upper ends of upper post portions 60. Frame member 66 is secured at one end to one upper post portion 60 and is mounted at its other end within a sleeve 68 on the other post portion 60 for adjustable relative movement. A suitable set screw in sleeve 68 (not shown) engages upper frame member 66 to position frame member 66 accurately. As described, frame 46 is adjustable in height and length to accommodate bed 10 and to adjust the support height of the rear side of bath tub 20.

Figure 4:
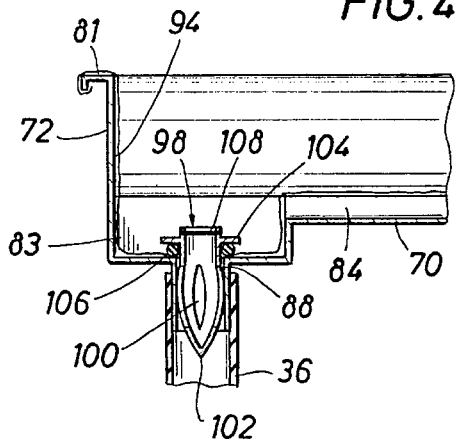
FIG. 4 is an enlarged section taken generally along line 4—4 of FIG. 3 and showing a discharge opening for waste bath water with a perforated plug therein for puncturing and positioning a removable liner within the bath tub.
Figure 3:
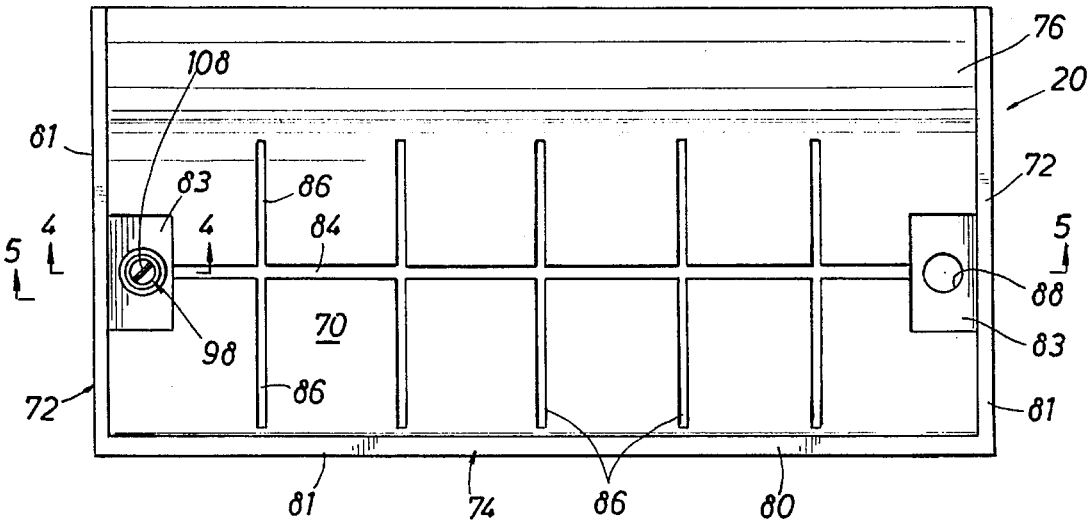
FIG. 3 is a top plan of the bath tub shown removed from the bath tub assembly.
Figure 5:
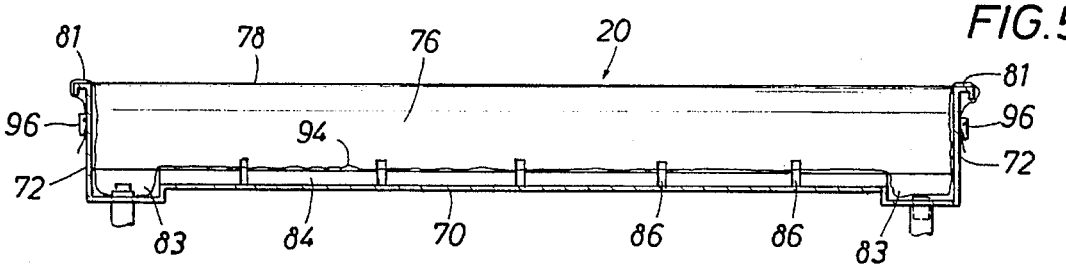
FIG. 5 is a section taken generally along line 5—5 of FIG. 3.

Referring now particularly to FIGS. 3–5, bath tub 20 is shown removed from support frame 46 and bed 10. Bath tub 20 has an integral elongate body including a bottom 70 and three connected sides 72, 74 extending vertically upwardly from bottom 70. The body may be manufactured of fiberglass or plastic material, or of a light weight strong metal such as aluminum. The preferred construction material is co-extruded acrylic-ABS plastic. Sides 72 form opposed ends of tub 20. Side 74 forms a rear side. Bottom 70 on the front side opposite rear side 74 slopes gradually upwardly to define a sloping front side 76 having a smooth upper surface for sliding a patient in a prostrate position along such smooth surface into and out of bath tub 20 without lifting of the patient. Front side 76 slopes upwardly from bottom 70 at an angle less than about 45 degrees to facilitate manual movement of patient P along front side 76 particularly when the patient is returned to the bed 10 from the tub 20. The upper portion of front side 76 has a marginal edge portion 78 (see FIGS. 6 and 7) which extends therefrom with a lip or rib 80 projecting downwardly from the front edge 82. Lip 80 reinforces marginal portion 78 and presses downwardly to grip mattress 12 when marginal edge portion 78 overlaps mattress 12 as shown particularly in FIGS. 6 and 7. Lip 80 thus serves to position tub 20 and to maintain tub 20 in an overlapping relation with bed 10 and mattress 12 particularly upon vertical movement of support frame 14. It also serves to inhibit separation of tub from mattress, particularly with the embodiment of FIG. 10. Lip 80 may be serrated to provide enhanced gripping of the mattress 12, if desired. Marginal edge portion 78 preferably overlaps mattress 12 a distance of at least about six (6) inches. Overlapping of portion 78 with mattress 12 provides the preferred means for coupling of tub 20 to bed 10 for vertical movement with support frame 14 of bed 10.

Marginal edge portion 78 forms a bridge between bed 10 and tub 20 over which the patient is moved when transferred sidewise in prostrate position between bed 10 and bath tub 20. Of course the tub itself is bridged between bed 10 and the support frame 46. Sides 72 and 74 (referring again to FIG. 3) have channel-edged ribs or flanges 81 which reinforce the sides. Edge portion 81 on rear side 74 is supported on upper frame member 66 (see FIGS. 6 and 7). Thus, tub 20 is supported by frame member 66 and mattress 12 when in an operable position for bathing of a patient. Tub 20 is lightweight so that it may be easily lifted from or lowered onto mattress 12 and frame member 66. As shown in FIG. 7, patient P while in a prostrate position may be transferred across marginal portion 78 along the smooth surface of sloping front side 76 to bottom 70 of bath tub 20. Mattress 12 may then be raised to the position of FIG. 6. In this position water of a controlled temperature may be applied from nozzle 28 onto the patient (see FIG. 1 ). Bed 10 is normally provided for about ten (10) inches of vertical travel of mattress 12 with respect to legs 17. The depth of tub 20 is such that the patient P may be bathed in any position of mattress 12, because tub 20 will retain and drain water from any position of mattress 12 between the positions shown in FIGS. 6 and 7.

Bottom 70 may have sumps 83 provided at opposed ends thereof to receive waste water, but preferably only one sump on one end is provided. A longitudinal channel 84 extends between sumps 83. Transverse channels or slots 86 in bottom 70 are in fluid communication with longitudinal channel 84 to direct the waste water to sumps 83. A discharge outlet 88 is provided for each sump 83 and may be plugged, or connected to discharge hose 36 for drainage of the waste water from tub 20 as shown in FIG. 4. In order to assure that water drains to a sump 83 from the tub bottom, one of the vertical legs of the support frame may be shortened relative to the other so that the rear side 74 is supported at a shallow angle with respect to the horizontal floor.

As a sanitary measure to minimize infection and disease, a liner 94 as shown in FIG. 4 may be placed over tub 20 prior to each bath in tub 20. The liner 94 is preferably removed from tub 20 after each bath of a patient. Liner 94, may for example, comprise a thin polyethylene sheet which is stretched over the four corners of the generally rectangular tub 20. To secure liner 94, a plurality of manually depressible clips 96 as shown particularly in FIG. 8 may be provided on the outer surfaces of sides 72, 74, 76 to grip liner 94 tightly against tub 20 for releasable securement.

Referring to FIG. 9, a modified attachment of a liner 94 A to tub 20 is shown in which liner 94A has pocketed edges 95A which are adapted to fit over lip 80 of front side 76 and over channel shaped flanges 81 of sides 72, 74 (not shown). Liner 94A may be easily positioned on and removed from tub 20A.

An opening in liner 94 for the drainage of waste water is provided by a perforated plug or tool shown generally at 98 in FIG. 4. Plug 98 is hollow and has a plurality of slits or perforations 100 for the flow of water from sump 83 to discharge hose 36. A removable plug may be provided in the hollow cavity of plug 98 so as to prevent water from draining from the tub during bathing. Plug 98 has a sharp end 102 for the manual puncturing of liner 94 over discharge opening 88 after liner 94 is secured by clips 96. An extending flange 104 on plug 98 limits the downward manual pushing of plug 98. An O-ring 106 seals about plug 98. Plug 98 may, for example, be formed of a polyethylene plastic material. It is dimensioned and designed such that it is deformed upon being pushed downwardly within discharge outlet 88 to seal against the inner surface defining outlet 88. An upper cross pin 108 across hollow plug 98 may be gripped manually for removal of plug 98 from discharge outlet 88 upon removal of liner 94.

Figure 2:
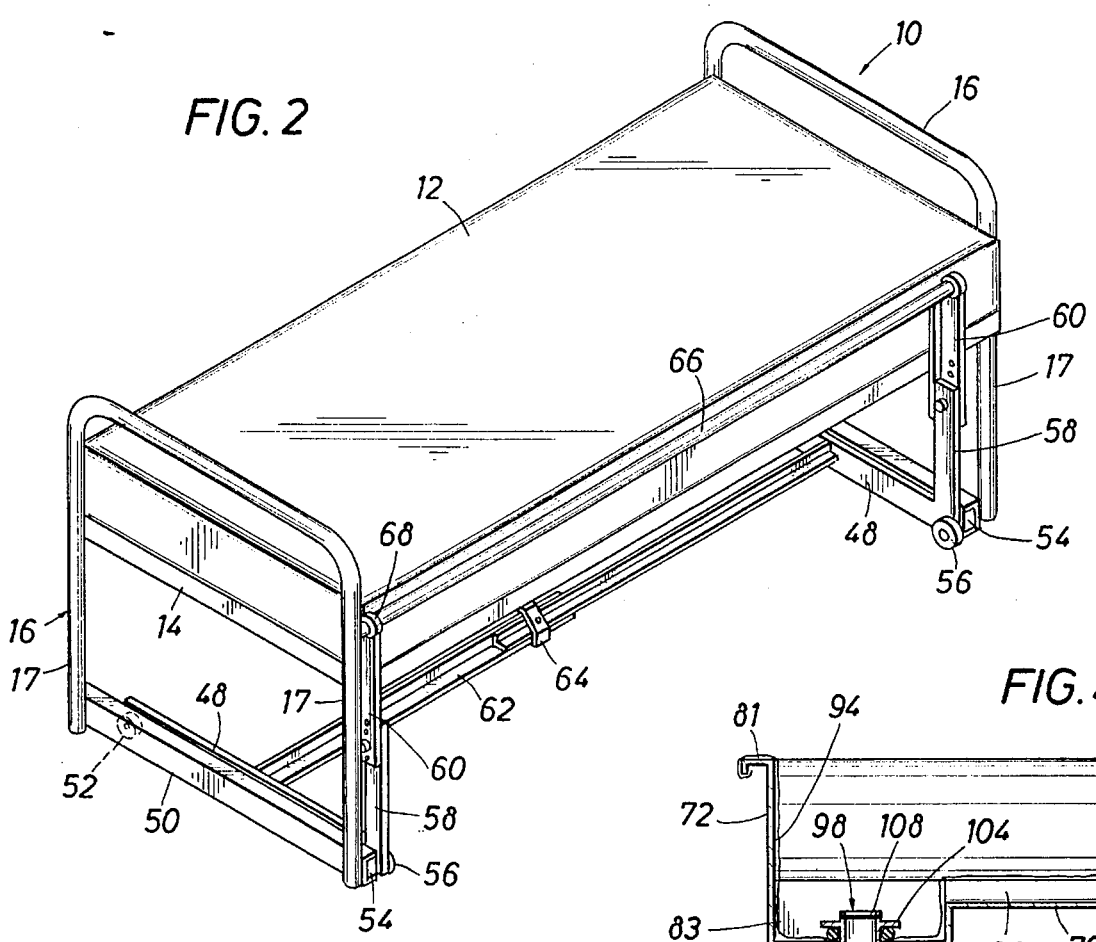
FIG. 2 is a perspective view of a support frame for a bath tub shown attached to a bed and in a retracted position after removal of the bath tub from the frame.

To provide for bathing of a bedridden patient, retracted support frame 46 which is attached to bed 10 and adjusted in length for bed 10 as shown in FIG. 2, is pulled outwardly to the position of FIG. 1. Upper vertical frame portions 60 are adjusted in height to position upper horizontal frame member 66 at the desired height for supporting bath tub 20. In the extended position of frame 46, bath tub 20 which has been stored separately is then lowered downwardly manually onto mattress 12 and upper frame member 66 with channel shaped edge 81 of rear side 74 fitting on upper frame member 66 and lip 80 pressing downwardly onto mattress 12 for supporting bath tub 20. Liner 94 is placed over tub 20 and secured thereto by clips 96. Next, liner 94 over discharge outlet 88 is punctured by pushing plug 98 within discharge outlet 88 until stopped by flange 104. Discharge hose 36 is connected to outlet 88 and drain hose 42 is connected to drain basin 34.

Bed 10 is preferably lowered to the position of FIG. 7 for sidewise movement of patient P over overlapping side marginal portion 78, and then downwardly along the smooth sloping surface of front side 76 onto bottom 70 without any lifting of patient P. After placing of patient P within tub 20, frame 14 and mattress 12 are raised to the position of FIG. 6. In this position, faucet 22 is turned on and water discharged through outlet 32 until the desired water temperature is reached. Then, lever 30 is actuated to supply water to line 26 and spray nozzle 28. Spray nozzle 28 is manually controlled to provide a desired stream of water onto the patient for bathing. Waste bath water is discharged from sump 83 through hose 36 into portable water collection container 38 for disposal. After bathing of the patient, frame 14 and mattress 12 are lowered to the position of FIG. 7, and the patient is transferred in a prostrate position along sloping front side 76 and across overlapping marginal edge portion 78 onto mattress 12. Liner 94 may then be removed by release of clips 96. For storing of bath tub 20, discharge hose 36 is removed from outlet 88. Bath tub 20 may then be lifted manually from mattress 12 and frame member 66 for removal and storage. Upper vertical post portions 60 of support frame 18 may be lowered and frame 18 moved to the retracted position shown in FIG. 2. As a result, a complete bath can be provided to a bedridden patient by sidewise movement of the patient in a prostrate position without any lifting of the patient. The phrase, "without any lifting of the patient", means that a patient P is not required to be lifted vertically to transfer a patient P from patient support surface 12 across the from 76 of tub 20 and into the bottom of the tub 20. Transfer of patent P is accomplished entirely by sliding action, not vertical lifting of the patient P. Care must be taken not to damage the liner 94 during such sliding action. If it appears that damage might occur to liner 94, a small amount of vertical lifting of patient P may be necessary to lift patient P from surface 12 onto the front side of tube 76 over the overlap area between the surface 12 and the front side of the tub. Of course when the patient P is transferred after bathing from the tub 20 to the bed 12, the patient P must be slid up a slope, as illustrated in FIG. 7, but no vertical lifting is required.

As shown and described hereinafter, mattress 12 and lower support frame 14 are preferably moved vertically by the arrangement shown in FIGS. 13 and 14. Additionally, a preferred support frame for tub 20 is pivotally mounted to bed 10 as shown particularly by the arrangement of FIGS. 15–17. Also, patient P is preferably transferred between bath tub 20 and mattress 12 on a slide board beneath patient P as shown and described particularly by the arrangement shown in FIGS. 18–23.

EMBODIMENTS OF FIG. 10

Bed 10A of FIG. 10 includes a mattress 12A which is supported by a vertically movable bed frame 14A. A box spring 13A may be positioned between mattress 12A and movable bed frame 14 A.

A modified support frame for the bath tub 20A is shown in which a portable support frame 17A is provided which is not attached to bed 10A. Support frame 17A includes a pair of spaced end frames 19A each having a lower support frame member 21A for floor support and a vertically extending post 23A. An upper generally U-shaped frame member 25A has vertical end portions 27A telescoping within posts 23A for vertical adjustment. Horizontal portion 29A of U-shaped frame member 25A supports bath tub 20A thereon. Bath tub 20A is generally identical to bath tub 20. It has a downwardly extending lip supported on mattress 12A as in the embodiment shown in FIGS. 1–8. To maintain support frame 17A at a precise lateral distance from mattress 12A, restraining members 31A are secured to each end frame 19A. Each restraining member 31A includes a strap 33A secured to vertical portion 27A. A rope 35A is secured to strap 33A and a retainer 37A is secured to the end of rope 35A. Retainer 37A comprises a relatively large diameter disc and is maintained in position by the weight of mattress 12A against the top surface of box springs 13A. A buckle type connection 39A between strap 33A and rope 35A permits rope 35A to be drawn tight upon positioning of retainer 37A against mattress 12A and box springs 13A for pulling retainer 37A tightly against mattress 12A and box springs 10A of bed 10. Retainer 37A may, if desired be positioned between a mattress and a support frame for the mattress where box springs 13A are not provided.

Other types of equivalent restraining devices may be connected between bed 10A and support frame 17A for the precise positioning of frame 17A and to prevent frame 17A from moving away from bed 10A. Also, various types of support flames could be provided for supporting the bath tub which is easily lifted from the frame for removal and storage. Various types of extending gripping members could also be provided on the overlapping edge portion of the bath tub for pressing downwardly to grip the mattress for holding and maintaining the tub at the desired location for bridging any gap between the tub and bed. Further, interlocking or interconnecting means between the tub and bed coupling the tub for vertical movement with the patient support surface, other than the overlapping gripping means shown in the drawings, may be provided. The bed, for example, could be provided with a releasable interlocking means for the tub so that the tub is movable vertically with the bed frame.

RIGID LINER—FIGS. 11 AND 12

Figure 11:
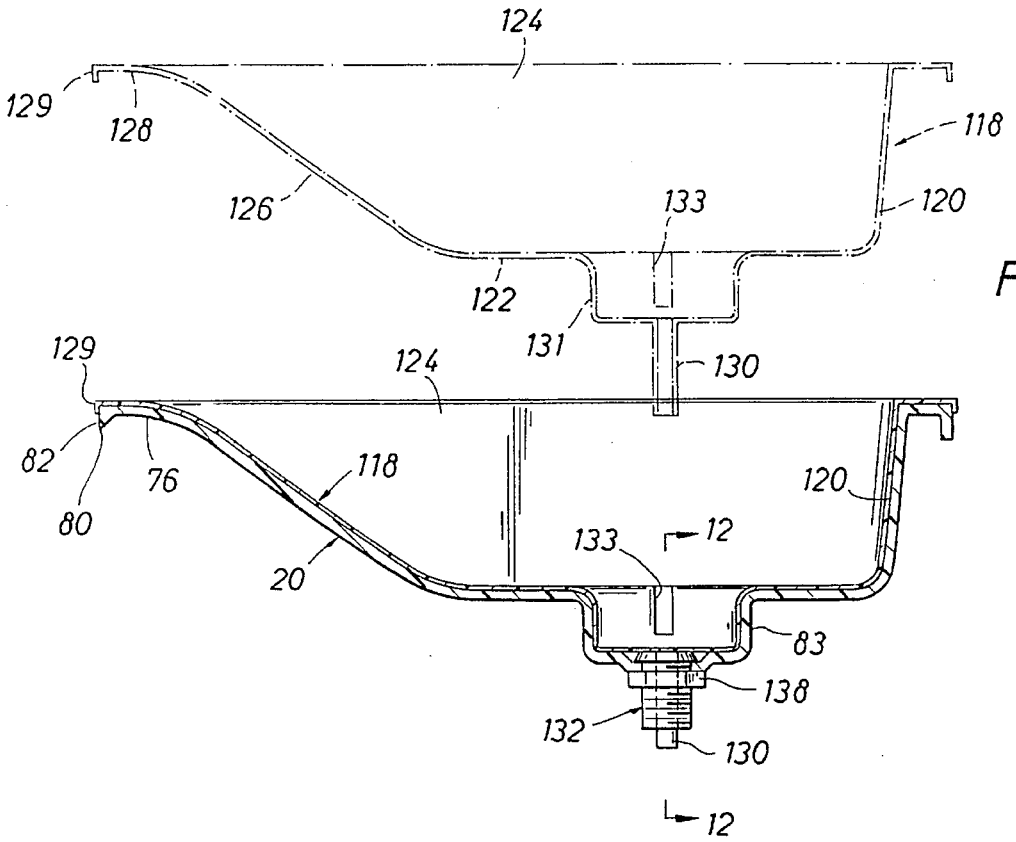
FIG. 11 is a transverse sectional view of a rigid liner fitting within a bath tub according to the invention and having a lower profile which conforms to the inner/upper surface of the bath tub.
Figure 12:
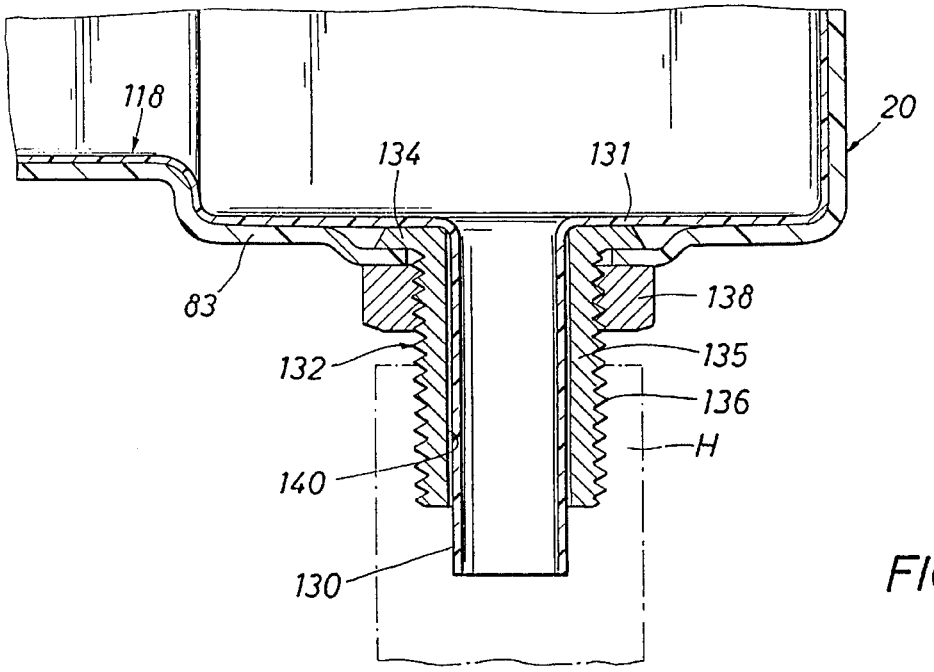
FIG. 12 is an enlarged section of the drain outlet for the bath tub taken generally along line 12—12 of FIG. 11 and showing a drain fitting for the outlet.

Referring to FIGS. 11 and 12, a rigid liner is shown at 118 which is molded to fit and conform to the inner contour or surface of bathtub 20. Liner 118 has a rear side 120, a bottom 122, opposed ends 124, and a front side 126 sloping upwardly from bottom 122 and forming a smooth continuation of bottom 122. A marginal side portion 128 of front side 126 overlies side 76 and has an outer flange 129 over front edge 82 of tub 20.

A lower outlet or spout 130 extends downwardly from a sump 131 in bottom 122 for the drainage of waste water from longitudinally extending channel 133 in liner 118. An outlet for tub 20 for liner 118 is shown in FIG. 12. A fitting 132 has an upper flange 134 and an externally threaded body 135 externally threaded at 136 for threaded connection with a suitable drain hose H, if desired. A nut 138 clamps tub 20 against flange 134 for securement of fitting 132. Body 135 has a central bore 140 to form the drain opening for sump 83. Spout 130 is received within opening 140 for drainage of waste water from tub 20. Liner 118 is normally inserted within tub 20 prior to bathing of the patient and may be removed after bathing the patient. Liner 118 may be formed of a suitable plastic material, such as a polyethylene or polypropylene material about 0.040 inch in thickness and may be suitably sterilized as a sanitary measure to minimize infection of the patient. Liner 118 for best results is at least about 0.025 inch in thickness to provide a desired rigidity.

FIGS. 13 AND 14—PREFERRED MEANS FOR RAISING AND LOWERING BED FRAME

Figure 6:
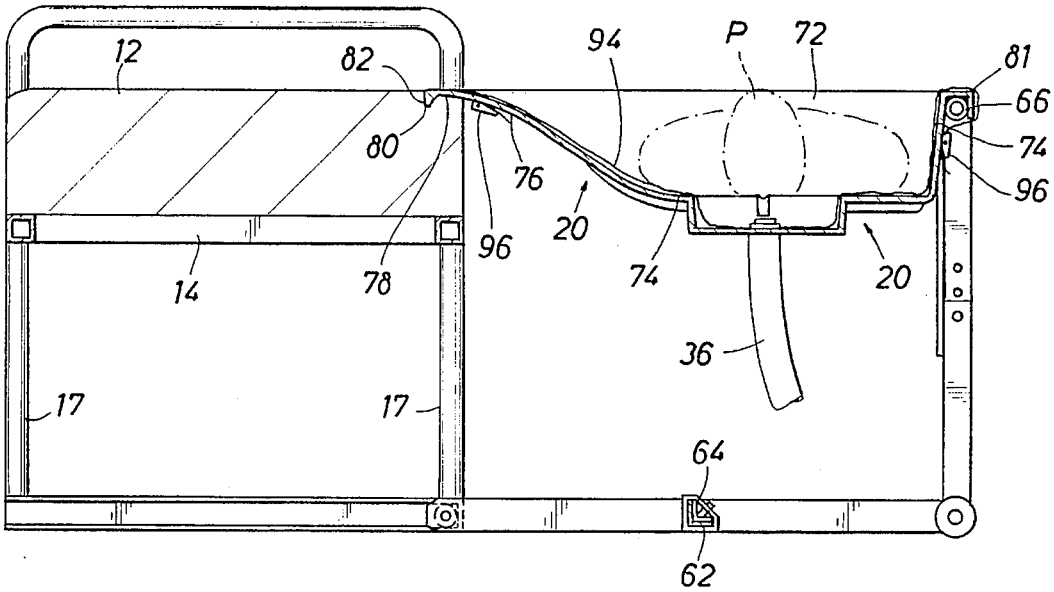
FIG. 6 is an end elevation, partly in section, showing a bath tub assembly in operable position along the side of a vertically movable bed with the bath tub in a raised position for bathing a patient and with the tub supported on its front side by the mattress of the bed.
Figure 7:
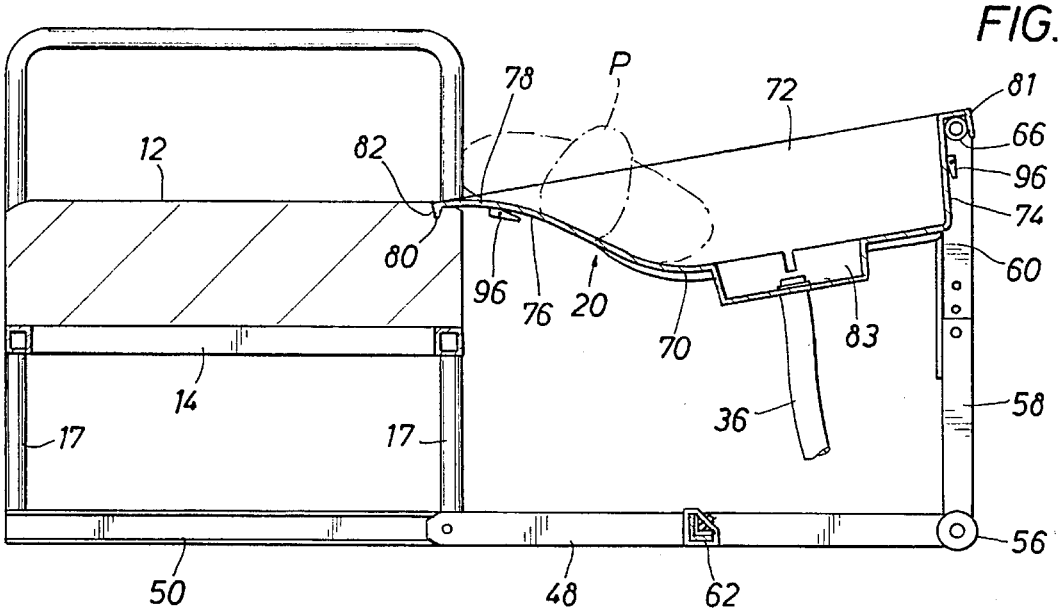
FIG. 7 is an end elevation similar to FIG. 6 but showing the bed in a lowered position and the bath tub tilted downwardly to a position for sidewise transfer of a patient between tub and bed.
Figure 13:
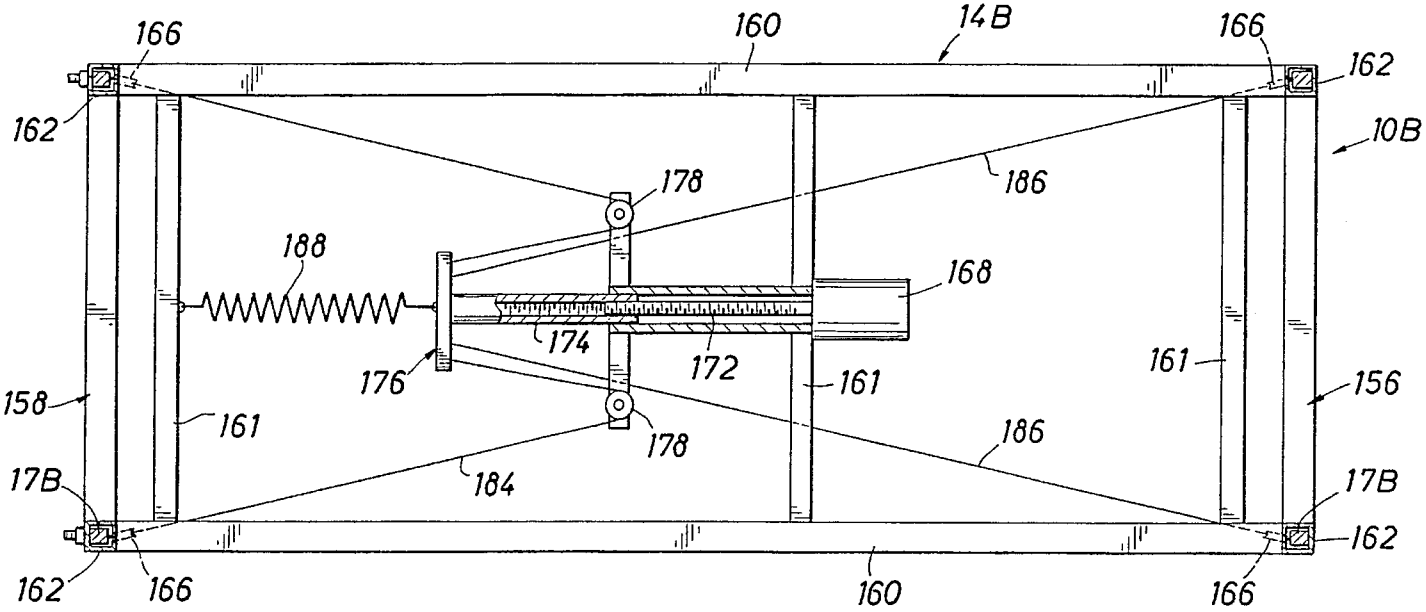
FIG. 13 is a top plan of a preferred mechanism for raising and lowering the bed frame and mattress.
Figure 14:
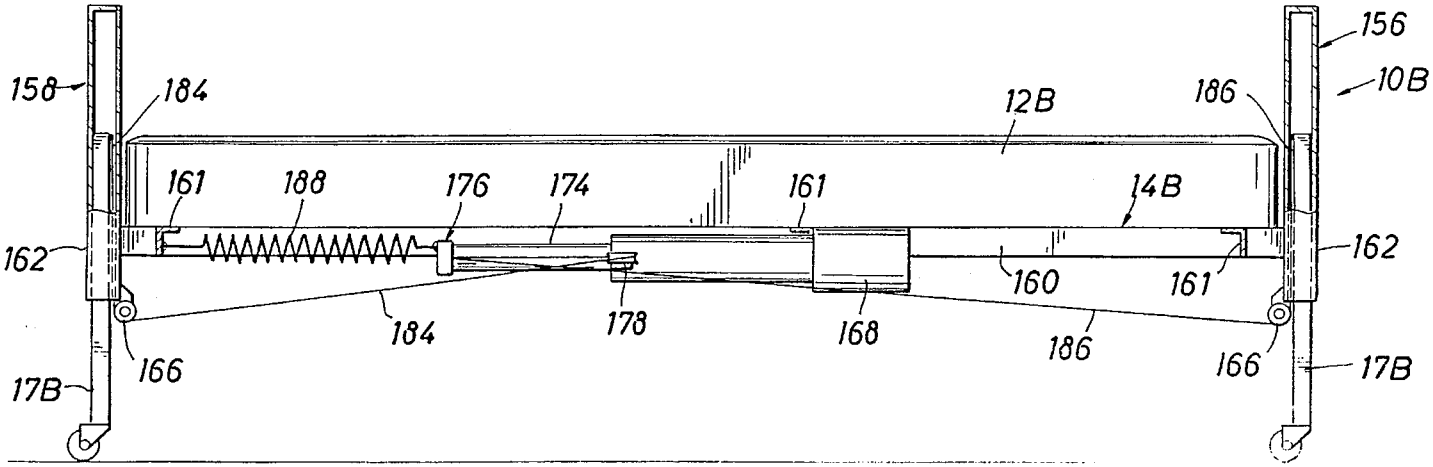
FIG. 14 is a side elevation of the preferred mechanism shown in FIG. 13.

Referring now to FIGS. 13 and 14, a preferred means for raising and lowering the main bed frame and mattress such as illustrated generally in FIGS. 6 and 7 is illustrated. Bed 10B has a main bed frame generally indicated at 14B for supporting mattress 12B thereon which forms a patient support surface. Main bed frame 14B includes a head board indicated at 156 and a foot board 158. Longitudinal frame members 160 extend between head board 156 and foot board 158. Sleeves 162 on head board 156 and foot board 158 telescopically receive legs 17B in a manner for vertical movement. Pulleys 166 are mounted on sleeves 162. An electrical motor 168 is mounted on an intermediate frame member 161 and rotates a lead screw 172 threaded within a sleeve 174 of a T-head assembly 176. Pulleys 178 are carried by a housing of lead screw 172 which is secured to intermediate frame member 161. Cables 184 are anchored at one end to T-head assembly 176, extend about pulleys 178, 166 and are anchored at an opposite end to the upper ends of legs 17B of foot board 158. Cables 186 are anchored at one end to T-head assembly 176, extend about pulleys 166, and are anchored at an opposite end to the upper end of legs 17B of head board 156. A return tension spring 188 is tensioned between T-head assembly 176 and adjacent frame member 161 for urging main bed frame 14B in an upward direction. Motor 168 is reversible for raising or lowering the main bed frame 14B and mattress 12B thereon as desired. For further details of the means of raising and lowering main bed frame 14B, reference is made to U.S. Pat. No. 3,436,769 dated Apr. 8, 1969 and U.S. Pat. No. 4,435,861 dated Mar. 13, 1984, which are incorporated herein by this reference.

FIGS. 15–17—ALTERNATIVE SUPPORT FRAME FOR TUB

Figure 15:
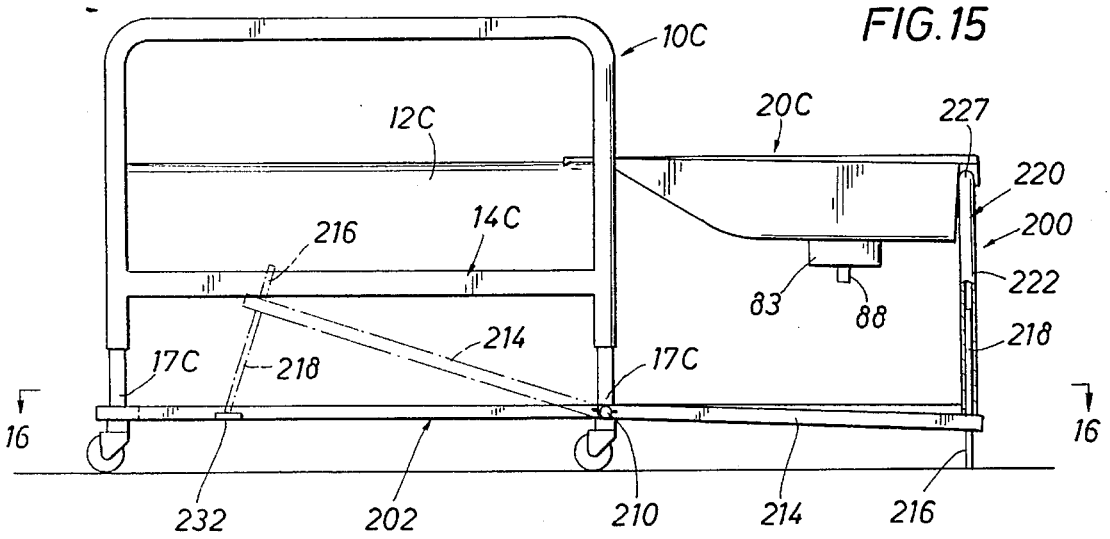
FIG. 15 is an end elevation of a preferred embodiment of a support frame for the bath tub in which lower base frame members are pivotally mounted on the bed legs for folding movement between operating and stored positions.
Figure 16:
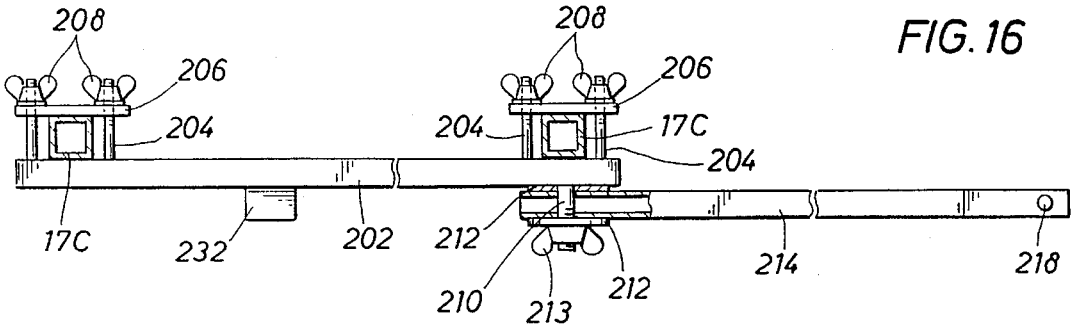
FIG. 16 is a top plan of the lower base frame member of the preferred embodiment at one end of the bed and taken generally along lines 16—16 of FIG. 15.
Figure 17:
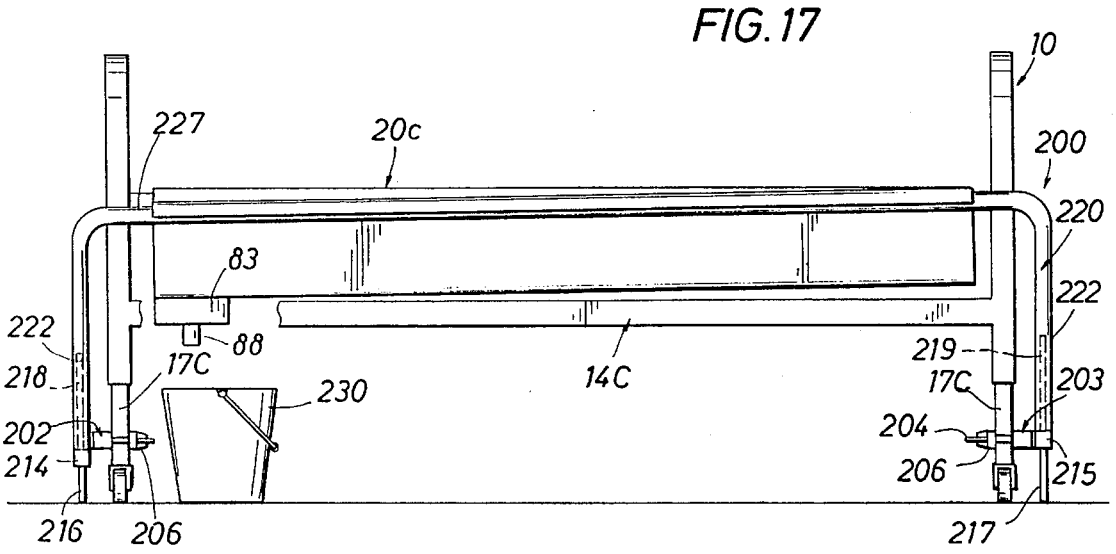
FIG. 17 is a side elevation of the preferred support frame and bath tub supported thereon.
Figure 21:
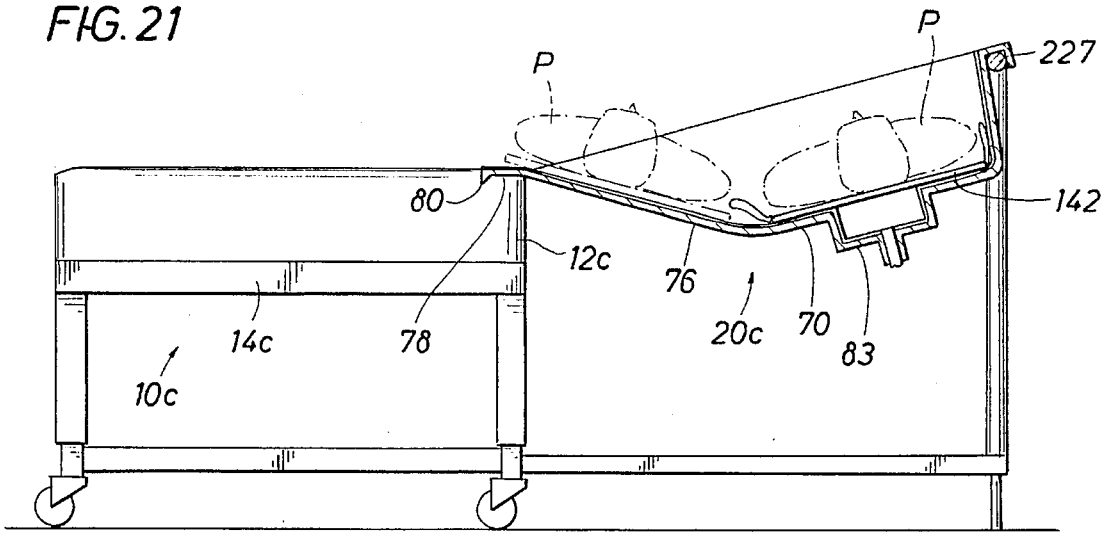

Referring now to FIGS. 15–17, a preferred embodiment of a support frame for bath tub 20C is illustrated. The support frame generally indicated at 200 is mounted on bed 10C to support bath tub 20C along one side of bed 10C. Tub 20C is similar to tub 20 of the embodiment of FIGS. 1–8. Bed 10C and bed frame 14C are generally similar to bed 10B and vertically movable bed frame 14B shown in FIGS. 13 and 14. Mattress 12C is provided on bed frame 14C. Support frame 200 includes a pair of end base frame members 202, 203 each removably connected to a pair of end legs 17C. End base frame member 202 is designed for positioning adjacent one end of bed 10C. End base frame member 203 is designed for positioning adjacent the opposed end of bed 10C. Base frame members 202, 203 are generally similar except designed for opposite ends of bed 10C.

Each frame member 202,203 has a pair of spaced studs 204 adjacent each end thereof to receive a bed leg 17C therebetween. A removable clamp plate 206 has openings for receiving studs 204 and may be tightly clamped against associated legs 17C by wing nuts 208 threaded onto studs 204. Studs 204 are spaced from each other a distance greater than the width of bed legs 17C so that end frame members 202,203 may accommodate beds legs 17C having different leg spacings. One end of each frame member 202, 203 has an externally threaded stud 210 extending therefrom to form a pivot for an inner end of an extending arm 214 on frame member 202 and an extending arm 215 on frame member 203. Washers 212 are positioned on opposed sides of arms 214,215 and wing nuts 213 mount arms 214,215 for pivotal movement about studs 210. The outer end of arm 2 14 has a lower support rod 216 and an upper support rod 218 secured thereto. The outer end of arm 215 has a lower support arm 217 and an upper support rod 219. Lower support rod 217 on arm 215 is of a length which is about ¾ inch to 1 inch greater than the length of lower support rod 216 on arm 214 as shown particularly in FIG. 17.

An upper U-shaped frame member 220 formed of metal tubing has ends 222 which fit over and receive upper rods 218, 219 in telescoping relation. Horizontal frame member 227 between ends 222 of U-shaped frame member 220 support the rear side of bath tub 20C for relative pivotal movement as in the embodiment of FIGS. 1–8. Bath tub 20C has a sump 83 at one end thereof with a discharge outlet 88 extending therefrom for the drainage of waste water from tub 20C into a bucket 230 or other liquid container. By providing lower support rods 216 and 217 with different lengths for end frame members 202 and 203, bath tub 20 supported on U-shape frame member 220 slopes downwardly toward sump 83 as shown in FIG. 17 to facilitate the drainage of waste water from bath tub 20C. When not in use, bath tub 20C may be lifted and removed from support frame 200 and moved or stored in a different location. Next, U-shaped frame member 220 is lifted from upper rods 218,219 on arms 214,215. Arms 214, 215 are then folded or pivoted about studs 210 to the broken line position shown in FIG. 15 in which support rods 218, 219 contact support plates 232 which extend outwardly from frame members 202, 203. Support frame 200 may be mounted on either side of bed 10C upon disassembly of lower frame members 202,203 from legs 17C. Tub 20C, if desired, may have a rigid liner inserted therein similar to the liner of FIGS. 11 and 12. Also, U-shaped upper frame member 220 may be formed to be adjustable in length and to be adjustable in height such as the similar frame members shown in FIGS. 1 and 2 in the embodiment of FIGS. 1–8.

While FIGS. 6 and 7, along with FIGS. 13 and 14, show a mechanism on a bed for raising and lowering a bed frame and mattress of a bed on which a side of a bath tub is supported for vertical movement therewith, it is to be understood that the vertically movable bed frame may be utilized for lifting other adjacent patient support devices, such as a gurney, or wheelchair convertible to a gurney, for example, so that a patient may be transferred in a prostrate position in a sliding action between the two adjacent patient support surfaces on the bed and on a gurney, for example. The adjacent patient support surface on the gurney is coupled to the vertically movable bed frame so that it is raised and lowered along with the bed frame or patient support surface on the bed frame.

FIGS. 18–23—PREFERRED METHOD FOR PATIENT TRANSFER

Referring now to FIGS. 18–23, a preferred method of manually transferring a patient between a bed and a tub is illustrated in which a patient is first positioned on a slide board 142 for sidewise transfer in a prostrate position to tub 20C. As shown in FIG. 18, slide board 142 with patient P secured thereto is positioned on mattress 12C for transfer to adjacent tub 20C. For initially positioning patient P on slide board 142, slide board 142 is slipped beneath patient P on mattress 12C. The upper surface of mattress 12C forms a patient support surface for patient P. Tub 20C is substantially identical to tub 20 of the embodiment of FIGS. 1–8 and like numerals indicate similar parts.

Slide board 142 is preferably formed of polyethylene of about ⅛ inch in thickness. Slide board 142 has openings 146 therein to provide handholds for gripping by an attendant to pull slide board 142 with patient P thereon. The width and length of flexible slide board 142 are of dimensions generally similar to the corresponding dimensions of a patient P and may, for example, be nineteen (19) inches in width and sixty-seven (67) inches in length. If the length of a patient P exceeds the length of slide board 142, the legs of patient P may extend beyond the end of slide board 142. Suitable straps such as shown at 145 may be connected to handholds 146 for gripping to pull slide board 142 and patient P. Additional straps including suitable releasable buckles may be provided for securing a patient P onto slide board 142, if desired.

Slide board 142 is preferably positioned beneath patient P before bath tub 20C is positioned beside bed 10C so that an easy access to the patient is provided. After slipping of the thin slide board 142 beneath patient P, the patient is then rolled onto a side as shown in FIG. 19. Then, a back cushion 144 and a neck cushion or pad 148 are placed on slide board 142 beneath the torso and neck of patient P. The patient is then returned to a prostrate position resting on cushions 144, 148 of slide board 142 for transfer from bed 10C to tub 20C for bathing. Cushions 144, 148 are preferably formed of a closed cell polyurethane foam material dipped in a vinyl material and of a thickness of about ¾ inch.

FIGS. 20–23 show in sequence the stages involved in transferring patient P on slide board 142 between bed 10C and tub 20C without lifting the patient. A substantially rigid liner 118 has been previously inserted within tub 20C in interfitting relation with outlet 130 positioned within drain opening 140. After the patient P has been positioned on slide board 142 with bed frame 14C in a lowered position, the support frame for tub 20C, such as frame 200, is pivoted to its operable position beside bed 10C for supporting tub 20C as shown in FIG. 20. Tub 20C with liner 118 then is placed on tipper frame member 227 of frame 200 with side marginal portion 78 overlapping mattress 12C for about six (6) inches with lip 80 pressing downwardly into the upper surface of mattress 12C. Lip 80 grips mattress 12C and inhibits separation of bath tub 20C from bed 10C.

Figure 22:
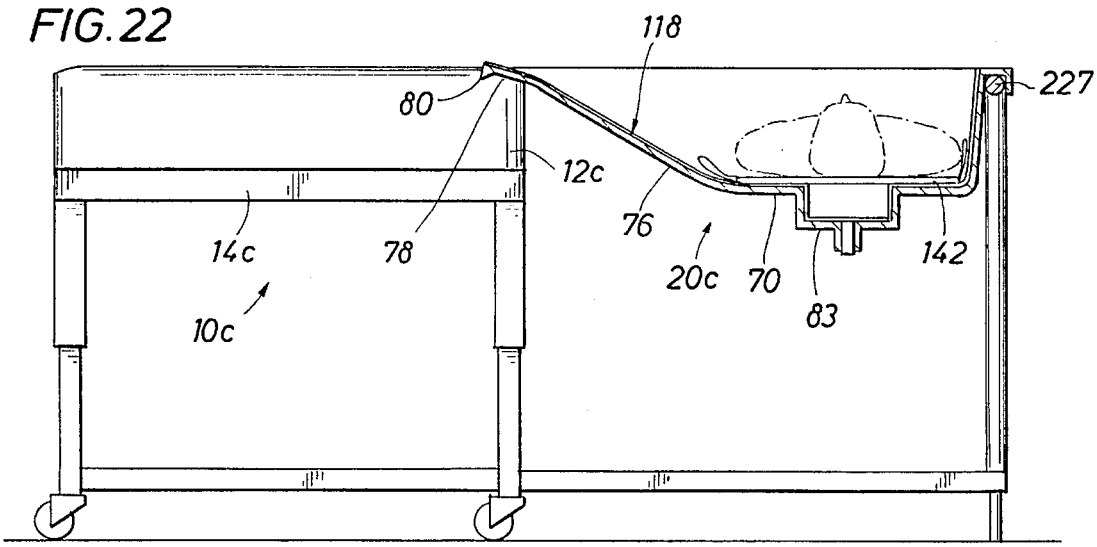
Figure 23:
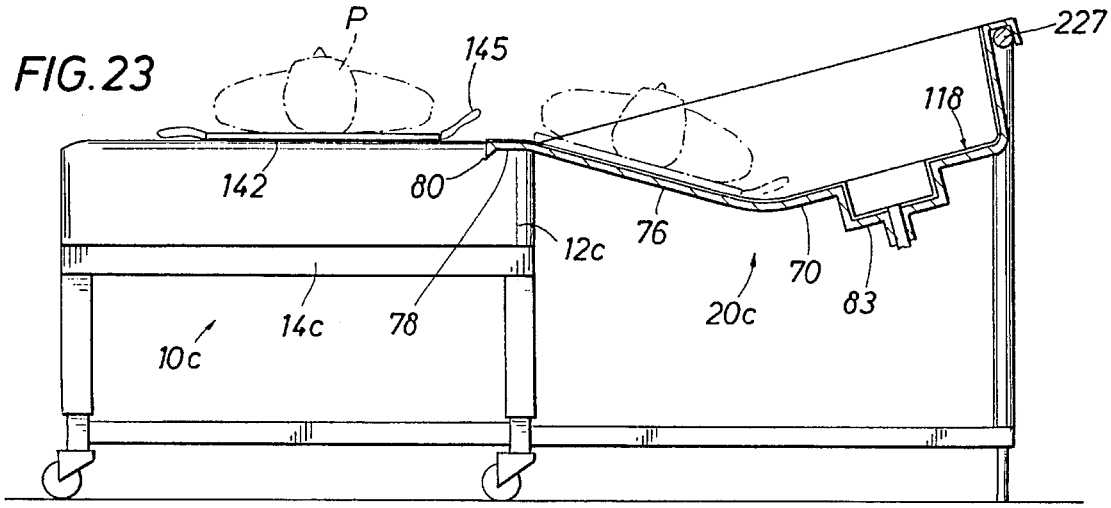

In this position, movable bed frame 14C and mattress 12C are in a lowered position as shown in FIG. 20. An attendant then grips slide board 142 at handholds 146 or straps 145 and slides slide board 142 with patient P thereon down along the tipper surface of front side 76 of tub 20C onto the bottom 70 as shown particularly in FIG. 21. In such position, bed frame 14C and mattress 12C are raised to the position shown in FIG. 22 for bathing of patient P. Bottom 70 is then in a horizontal position, and the front and rear sides of bath tub 20C are at the same height as illustrated in FIG. 22. The patient P is then bathed in the raised position of bathtub 20C as shown in FIG. 22. After bathing, bed frame 14C along with mattress 12C and bath tub 20C are lowered to the position shown in FIG. 23. In this position, openings 146 in slide board 142 or straps 145 are gripped by an attendant to move slide board 142 and patient P upwardly along smooth front side 76 for transfer to bed 10C. After return to bed 10C, the patient P may be rolled on a side for removal of cushions 144, 148 and slide board 142 from bed 10C. As described, the patient P is transferred between bed 10C and bath tub 20C without any lifting of patient P. Tub 20C may then be manually lifted from frame 200 and stored. Frame 200 pivoted to a retracted stored position.

While slide board 142 is generally rigid with some flexibility, it may be desirable under certain conditions, to provide lesser or increased flexibility for slide board 142. Slide board 142 facilitates the movement of patient P, and particularly the manual sliding movement of patient P along the sloping front side 76 of tub 20C. While patient P has been illustrated in the drawings as being in a supine position, it may be desirable under certain conditions that patient P be in prone position on slide board 142. Under some conditions, a fabric sheet might be positioned beneath patient P for sliding patient P between bed 10C and tub 20C.

Certain beds may not be movable vertically. The bed, bath tub, and rear support arrangements will nevertheless be useful. FIG. 22 illustrates such a condition where a patient must be transferred between bed and tub bottom down or up a steeper slope than that illustrated in FIGS. 21 and 23 where a bed may be lowered to a lower position. Alternatively, as with a fixed height bed, the support frame 200 may be provided with manual or powered mechanism for raising it with respect to the height of the bed (e.g., the relationship of FIGS. 21 and 23) or lowering it for the bathing condition of FIG. 22.

Since certain changes or modifications may be made in the disclosed embodiments without departing from the inventive concepts involved, it is the aim of the appended claims to cover all such changes and modifications falling within the true spirit and scope of the present invention.

What is claimed:

1. A method for transferring a prostrate patient sidewise between a patient support surface of a bed and a bath tub assembly, where the patient support surface of the bed may be raised and lowered vertically while said patient support surface remains in a horizontal orientation and where the bath tub assembly includes a bath tub support structure and a bath tub which is partially supported from said support structure such that the bath tub may pivot about a longitudinal axis of the support structure, the bath tub having a bottom and a sloping front side which is fixed to the bottom and extends upwardly from said bottom at a shallow angle, the method comprising the steps of, positioning said bath tub and said support structure adjacent a longitudinal side of said bed with said front side of said bath tub overlapping said patient support surface of said bed, lowering said patient support surface vertically on said bed while said support surface remains in a horizontal orientation, thereby moving said from side of said bath tub to a lower transfer position, which results from pivoting said bath tub downwardly about said support structure until said front side of said bath tub is at a substantially decreased angle to said patient support surface as compared to said shallow angle of said from side of said tub with respect to said bottom, and sliding said prostrate patient from said patient support surface across said from side of said tub into said bottom of said tub.

2. The method of claim 1 further including the steps of raising vertically said patient support surface on said bed while said support surface remains in a horizontal orientation and said front side of said bath tub to a bathing position which results from pivoting said bath tub upwardly about said support structure until said front side of said bath tub is at a substantially increased angle to said patient support surface as compared to said shallow angle of said front side of said bath tub to said patient support surface in said transfer position, and bathing the patient within said bath tub.

3. The method of claim 2 further comprising the step of lowering said patient support surface while said support surface remains in a horizontal orientation and said front side of said bath tub to said transfer position, and sliding said prostrate patient sidewise from said bottom of said bath tub over said front side of said tub and onto said patient support surface of said bed.

4. The method of claim 1 further including the step of:

inserting a substantially rigid liner which conforms to the shape of said bath tub into said bath tub prior to sliding said patient into said bottom of said bath tub.

5. The method of claim 1 further including the step of placing patient on said patient support surface onto a slide board; and said sliding step is characterized by sliding said slide board with said patient thereon over said front side of said tub into said bottom of said bath tub.

6. A method for bathing a prostrate patient after sidewise transfer between a bed hating a vertically movable patient support surface and a bath tub having a bottom and a front side fixed to the bottom of the tub comprising the following steps of positioning the bath tub by the side of the said bed with said fixed front side of said bath tub partially overlapping said patient support surface of said bed and supported thereby;

moving said patient support surface on said bed to a lower position along with said bath tub supported thereon;

sliding said patient sidewise over the front side into said bottom of said bath tub;

raising said vertically movable patient support surface to an upper position along with said bath tub supported thereon; and bathing the patient while positioned on said bottom of said bath tub while said bath tub is in a raised position.

7. The method of claim 6 further comprising the steps of:

lowering said vertically movable patient support surface and said bath tub; and then sliding said patient sidewise over said front side of said bath tub onto the patient support surface of said bed for return of said patient to said bed.

8. The method as set forth in claim 6 further including the step of: inserting a substantially rigid liner within said bath tub prior to bathing of said patient.

9. The method as set forth in claim 6 further including the steps of:

placing a slide board between said patient and said patient support surface;

sliding said slide board with said patient thereon along said front side into said bottom of said tub; and sliding said slide board with said patient thereon along said front side to said patient support surface after bathing.

10. A method for transferring a patient between a bed having a patient support surface which may be moved vertically while in horizontal orientation and a bath tub, said method comprising the steps of:

positioning said patient on a slide board;

positioning said bath tub by a longitudinal side of said bed with a front side of said bath tub adjacent said patient support surface of said bed;

supporting said bath tub for pivoting motion about a longitudinal axis coupling said front side of said bath tub to said bed for vertical movement with said patient support surface;

lowering said patient support surface while remaining in a horizontal orientation and said front side of said bath tub from an upper position to a lower position while said bath tub pivots downwardly about said longitudinal axis;

sliding said slide board and said patient sidewise over said front side into said tub; and raising said vertically movable patient support surface and said front side of said tub to said upper position while said bath tub pivots upwardly about said longitudinal axis.

11. The method of claim 10 further including the steps of lowering said vertically movable patient support surface and said front side of said bath tub to said lower position; and sliding said slide board and said patient over said front side onto said patient support surface of said bed.

12. The method of claim 10 including the step of inserting a substantially rigid liner within said bath tub prior to transfer of said patient therein.

* * * * *